US007402056B2

(12) United States Patent
Lutsch et al.

(10) Patent No.: US 7,402,056 B2
(45) Date of Patent: Jul. 22, 2008

(54) LOCKING MECHANISM AT AN ELECTRICAL CONNECTION ASSEMBLY

(75) Inventors: Harald Michael Lutsch, Ottrau (DE); Ranko Resman, Zagreb (HR); Zelimir Loncar, Zagreb (HR); Vladimir Buden, Zagreb (HR)

(73) Assignee: Yazaki Europe Ltd., Hertfordshire (GB)

( * ) Notice: Subject to any disclaimer, the term of this patent is extended or adjusted under 35 U.S.C. 154(b) by 0 days.

(21) Appl. No.: 11/866,635

(22) Filed: Oct. 3, 2007

(65) Prior Publication Data

US 2008/0090426 A1 Apr. 17, 2008

(30) Foreign Application Priority Data

Oct. 11, 2006 (DE) ..... 10 2006 048 446

(51) Int. Cl.
*H01R 13/629* (2006.01)

(52) U.S. Cl. ..... 439/157; 439/347

(58) Field of Classification Search ..... 439/157, 439/347

See application file for complete search history.

(56) References Cited

U.S. PATENT DOCUMENTS

| | | | | |
|---|---|---|---|---|
| 4,875,873 | A * | 10/1989 | Ishizuka et al. | 439/347 |
| 5,695,349 | A | 12/1997 | Taguchi et al. | |
| 5,848,912 | A | 12/1998 | Okabe | |
| 5,928,014 | A * | 7/1999 | Sawayanagi et al. | 439/157 |
| 6,419,507 | B2 * | 7/2002 | Kurimoto | 439/157 |
| 6,422,882 | B1 * | 7/2002 | May et al. | 439/157 |
| 6,979,213 | B1 * | 12/2005 | Mauney et al. | 439/157 |
| 2003/0114044 | A1 | 6/2003 | Nakamura et al. | |
| 2004/0192090 | A1 | 9/2004 | Flowers et al. | |

FOREIGN PATENT DOCUMENTS

| | | | |
|---|---|---|---|
| DE | 92 17 849.9 | U1 | 4/1993 |
| DE | 195 43 009 | C2 | 5/1996 |
| DE | 199 32 113 | A1 | 1/2001 |
| EP | 1 093 191 | A2 | 4/2001 |
| EP | 1 655 813 | A1 | 5/2006 |
| WO | WO 2005 101583 | A1 | 10/2005 |

* cited by examiner

*Primary Examiner*—Briggitte R Hammond
(74) *Attorney, Agent, or Firm*—Sughrue Mion, PLLC

(57) ABSTRACT

A locking mechanism at an electrical connection assembly, comprising a first locking portion 3 which is attached to an elastically deformable locking arm 2 which forms part of a first element 1 of the connection assembly; a second locking portion which is connected to a second element of the connection assembly and which can be made to engage or to be disengaged from the first locking portion 3; a securing slide 12 which is linearly adjustably guided in a guide, which is urged by a spring element 18 into a first position in which is prevents the locking arm 2 from being elastically deformed and which comprises a control face which is loadable by the second element in such a way that the securing slide 12 can be transferred into a second position in which it permits the locking arm 2 to be elastically deformed, wherein the guide 8 is associated with the first element 1, wherein the locking arm 2, in a deforming direction 5, is elastically deformed towards the guide 8 from an untensioned position and wherein the securing sleeve 12 is adjustably guided in a setting direction 6 between the locking arm 2 and the guide 8 transversely to the deforming direction 5.

13 Claims, 9 Drawing Sheets

LOCKING MECHANISM AT AN ELECTRICAL CONNECTION ASSEMBLY

BACKGROUND OF THE INVENTION

The invention relates to a locking mechanism at an electrical connection assembly wherein a first locking portion is attached to an elastically deformable locking arm which forms part of a first element of the connection assembly and can be made to engage or to be disengaged from a second locking portion at a second element of the connection assembly.

More particularly, the invention relates to securing the elastically deformable locking arm against being displaced in the connected condition in order to prevent unintentional disengagement of the two elements from one another. The locking mechanism can be used for locking a connector with a fixed component, for example the body part of a motor vehicle, which fixed component is associated with a second connector to which the first connector is to be connected, or it can be used for achieving a direct locking effect between two connectors which are to be connected to one another or for locking an actuating lever at multi-pole connectors, which actuating lever is to facilitate the connection of the connectors in such a way that it cannot be actuated unintentionally.

For locking connectors to one another, it forms part of the state of the art to confirm the connected condition by additionally providing a slide which, for example in the course of connecting the connectors, initially remains in a first position and which, during the relative movement of the two connectors relative to one another, is subjected to a pretension so that, as soon as the final connected position between the two connectors has been achieved and as soon as the locking arm locking said connectors has been transferred into its final position, the slide is automatically moved forward under the spring force, so that it positions itself above the locking arm and additionally secures same against being moved into the open position. If the final position between the connectors is not achieved, the securing slide is not released, so that the spring force becomes effective due to pretension and presses apart the two connectors.

It is the object of the present invention to propose a locking mechanism which can be used for different functions which have to be realized at a connection assembly and does not permit an unintentional release of the locking arm.

SUMMARY OF THE INVENTION

In accordance with the invention, the objective is achieved by providing a locking mechanism at an electrical connection assembly, comprising

- a first locking portion which is attached to an elastically deformable locking arm which forms part of a first element of the connection;
- a second locking portion which is connected to a second element of the connection and which can be made to engage or to be disengaged from the first locking portion;
- a securing slide which is linearly adjustably guided in a guide, which is urged by a spring element into a first position in which is prevents the locking arm from being elastically deformed and which comprises a control face which is loadable by the second element in such a way that the securing slide can be transferred into a second position in which it permits the locking arm to be elastically deformed, wherein the guide is associated with the first element, wherein the locking arm, in a deforming direction, is elastically deformed towards the guide from an untensioned position and wherein the securing sleeve is adjustably guided in a setting direction between the locking arm and the guide transversely to the deforming direction.

The advantage of this embodiment is that, during the connecting process, the elastically deformable locking arm is automatically released in order to engage or to be disengaged from the locking portion at the second element, with the transfer of the securing slide into the releasing position (second position) being permitted to take place while the first element is connected to the second element, and when the final connected position between the elements has been achieved, the securing slide automatically returns into its first position (locking position), securing the elastically deformable locking arm against moving into the open position.

The first element for example can be a plug element of a connection assembly, which is connected for example to a body part of a motor vehicle in the form of the second element, which second element is firmly associated with a connector matching the plug element. However, the first element can also be a housing of a connector which is associated with an actuating lever which serves to connect the first connector to the second connector, with the second element being formed by the actuating lever. The purpose of such an assembly is to ensure that during the transport of the loose connector, the actuating lever cannot re-position itself, thus catching other elements such as a component of a wire harness. Furthermore, it is ensured that, in the connected condition of the two connectors, the position of the actuating lever, which corresponds to the connecting position, cannot be changed unintentionally. In addition, said locking mechanism can be used for directly locking two connectors when one of the connectors is provided with an elastically deformable locking arm and the other one with a locking projection.

In one embodiment of the invention, it is proposed for an assembly wherein the first element is a plug element and the second element a receiving element which, more particularly, is plate-shaped and wherein the plug element is connectable in a predetermined connecting direction

- that the elastically deformable locking arm is attached to the plug element and is elastically deformable transversely to the connecting direction in a deforming direction and comprises a projection in the form of a first locking portion projecting transversely to the connecting direction;
- that at the receiving element, there is formed a passage which is entered by the locking arm in the connecting direction and which comprises a locking face in the form of a second locking portion behind which the projection is positioned in the connected condition of the plug element and the receiving element and that the receiving element forms a stop at the passage;
- that the securing slide at the plug element is arranged in a space between the guide associated with the plug element and the locking arm so as to be adjustable transversely to the connecting direction and transversely to the first deforming direction of the locking arm; and
- that, during the process of the plug element being connected to the receiving element, the control face comes to rest against the stop of the passage, so that the securing slide is transferred against the force of the spring element into the second position.

The receiving element, more particularly, can be provided in the form of a portion of the body of a motor vehicle. The plug element comprises first contact elements and can be connected to a connector which comprises second contact elements matching the first contact elements, wherein the pug-in connector itself is secured directly to the second element, for example the vehicle body.

However, it is also possible for the plug element to comprise first electrical contact elements and for the receiving element to be provided in the form of the connector which can be connected directly to the plug element and comprises second electrical contact elements which match the first electrical contact elements and which, when being connected, come into contact with the first electrical contact elements. More particularly, it is proposed that the locking arm serves to lock the plug element with the plug connector.

For a further embodiment it is proposed that the first element is a plug element which comprises first electrical contact elements and can be connected a connector which comprises second contact elements matching the first contact elements; that the se-curing sleeve is attached to the plug element; that the second element is an actuating lever which is pivotably connected to the plug element, which supports the process of connecting the plug element to the connector and which comprises the second locking portion which can be made to engage the first locking portion by pivoting the actuating lever.

For all embodiments it is proposed that the securing sleeve is plate-shaped and comprises a base portion which, on one side, comprises an integrally formed-on, elastically deformable spring arm in the form of a spring element, the advantage being that the spring element forms a direct component of the securing slide, so that there is no need for separate springs to be mounted as individual parts. This results in more secure assembly conditions, and the number of required components is small. According to a preferred embodiment, it is proposed that, on a surface facing away from the guide of the plug element, the securing element comprises a securing projection which, in the first position of the securing slide, is positioned between the guide and an abutment face at the locking arm and blocks the latter to prevent same from being displaced and which, in the second position, is positioned outside the abutment face of the locking arm.

According to an advantageous embodiment, it is proposed that the locking arm comprises two parallel and spaced locking arm portions and that the abutment face is associated with one of the locking arm portions; and that, in the second position of the securing slide, the securing projection is arranged between the locking arm portions because it is possible to use one portion of the securing projection for restricting the lateral movement of the securing slide between its two positions.

The control face is preferably arranged on the side of the base portion of the securing slide, which side faces away from the spring element. In addition, the control face is arranged in the connecting direction in front of the locking portion of the locking arm in order to ensure that first the securing slide is transferred into the releasing position, so that the locking arm can be elastically deformed.

BRIEF DESCRIPTION OF THE DRAWINGS

Two preferred embodiments of the invention are diagrammatically illustrated in the drawing wherein.

DETAILED DESCRIPTION OF THE INVENTION

First there follows the description of a first application of the inventive locking mechanism with reference to an electrical connection assembly and, more particularly with reference to locking a first element 1 in the form of a plug element of the electrical connection assembly and more particularly, the elastically deformable locking arm 2 which is associated with said plug element and by means of which the first element 1 is secured to a second element in the form of a plate-shaped receiving element 30 and there, more particularly, in a passage 31 of same.

The second element 30 in the form of the plate-shaped receiving element can be provided for example in the form of a body portion of a motor vehicle, for example a door post in which the passage 31 is formed. In the space covered by the door post there is arranged a plug connector which is secured directly to the receiving element and to which the first element 1 in the form of a plug element is to be connected. In order to achieve an electrically conducting connection between the plug element and the further plug connector, both comprise contact elements (not illustrated) which, when being connected to one another come into contact with one another and achieve an electrical connection for devices or cables attached thereto.

Figure 1:
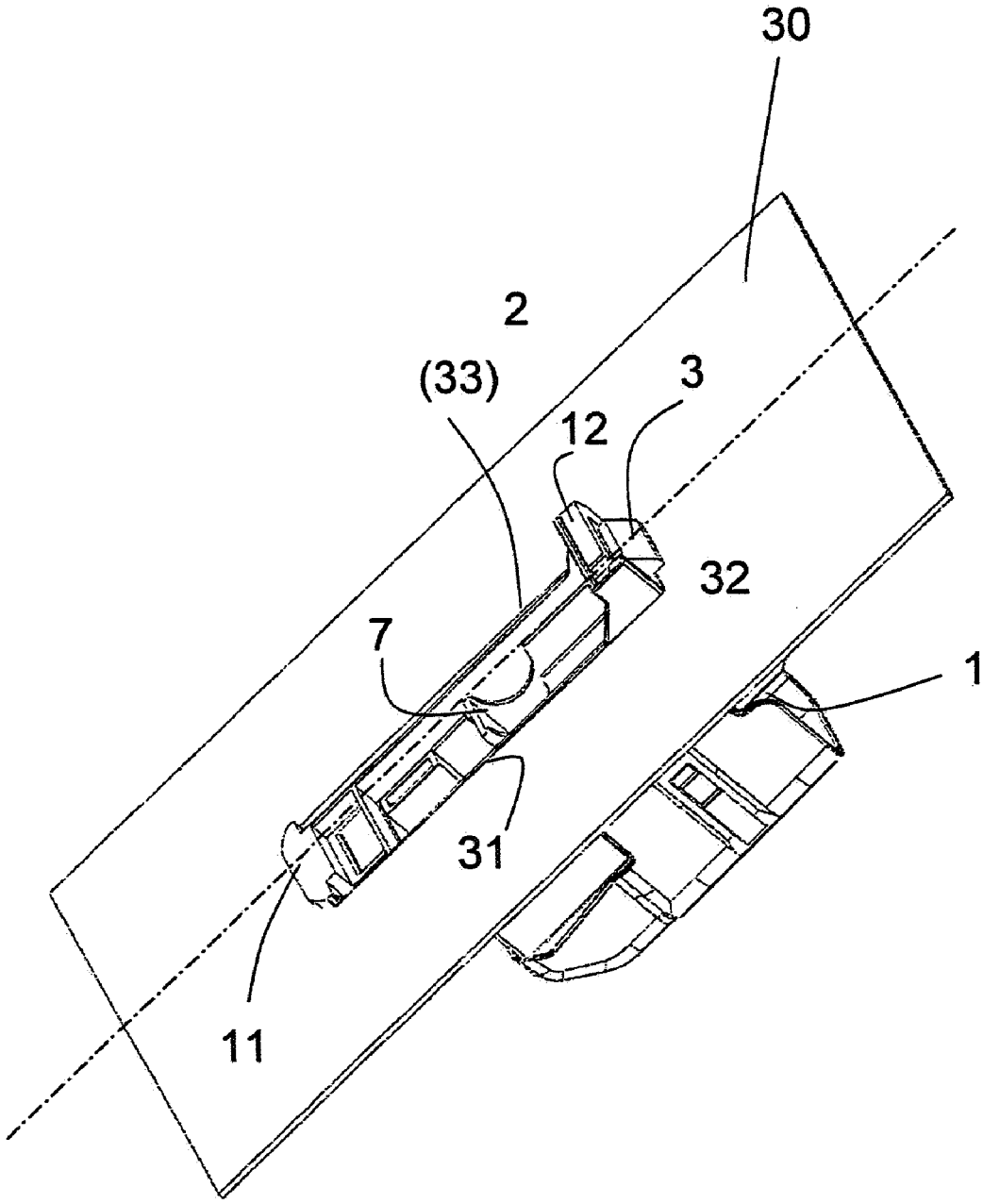
FIG. 1 is a perspective view of a first element in the form of a plug element of a connection assembly, secured to a second element in the form of a plate-shaped receiving element.

As can be seen in FIG. 1, a portion of the housing 7 of the first element 1 in the form of the plug element passes through the passage 31 in the second element 30 in the form of a plate-shaped receiving element, and a further non-visible portion of same abuts the surface facing away from the locking face 32 of the second element 30. The locking face 32 forms a second locking portion 32. This means that the first element 1 in the form of the plug element is also supported on said surface facing away from the locking face. A first locking portion 3 in the form of a projection which is provided at a locking arm 2 also passes through the passage 31 and positions it-self in front of the second locking portion 32 constituting a locking face. To ensure secure holding conditions, there is provided a holding projection 11 which also passes through the passage 31 and positions itself in front of the second locking portion 32 constituting a locking face. To prevent unintentional actuation of the locking arm 2, there is provided a securing slide 12 which is movable between two positions, i.e. a first position in which the securing slide 12 prevents the locking arm 2 from being elastically deformed, so that the locking arm 2, too, by means of its first locking portion 3 in the form of the projection, cannot unintentionally be disengaged from the second element 30 provided in the form of a plate-shaped receiving element, and a second position in which the securing slide 12 releases the locking arm 2, so that the locking arm 2, by means of its first locking portion 3 in the form of a projection, can be disengaged from the second element 30.

Figure 2:
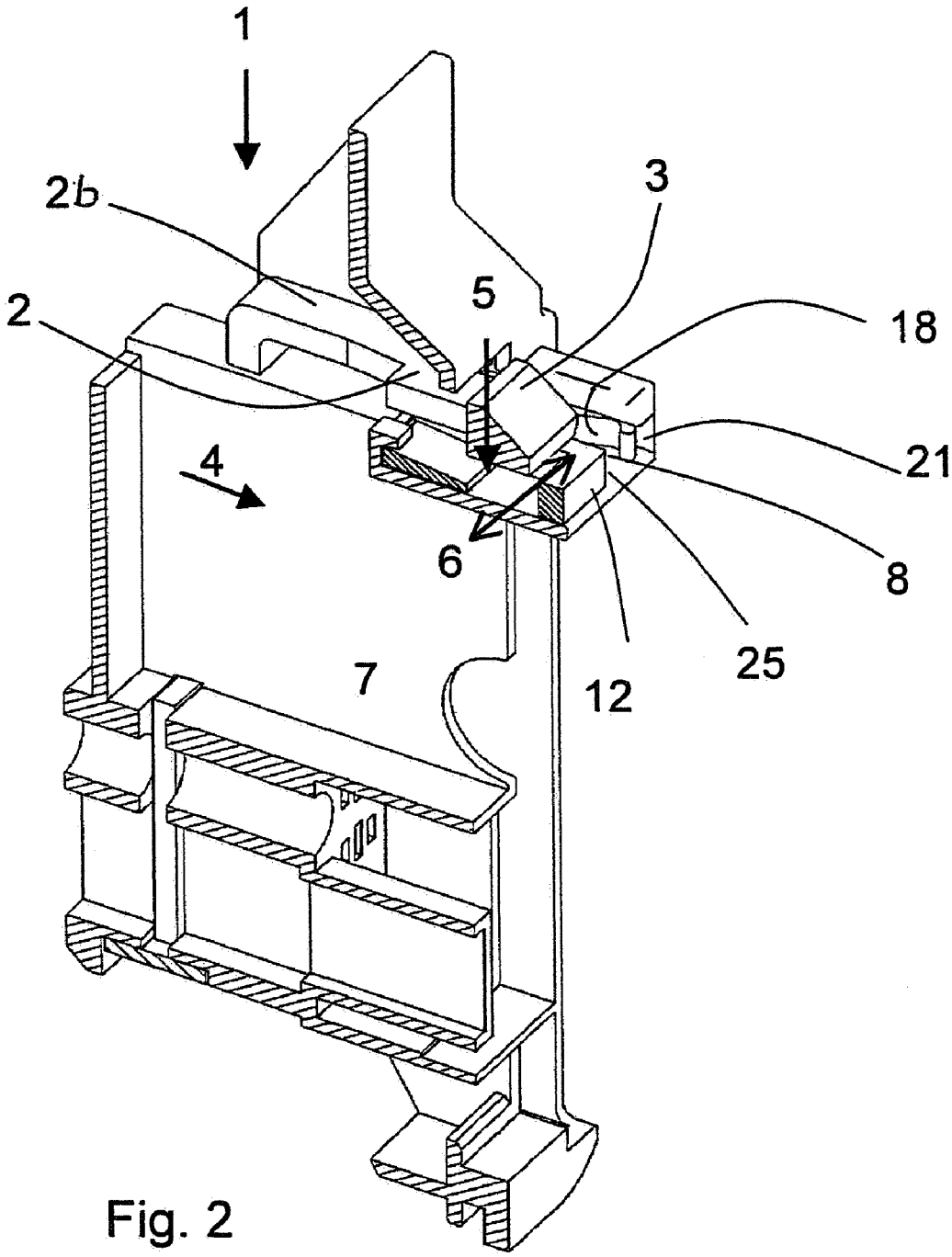
FIG. 2 is a section II-II of FIG. 1, but without the second element in the form of a plate-shaped receiving element.
Figure 3:
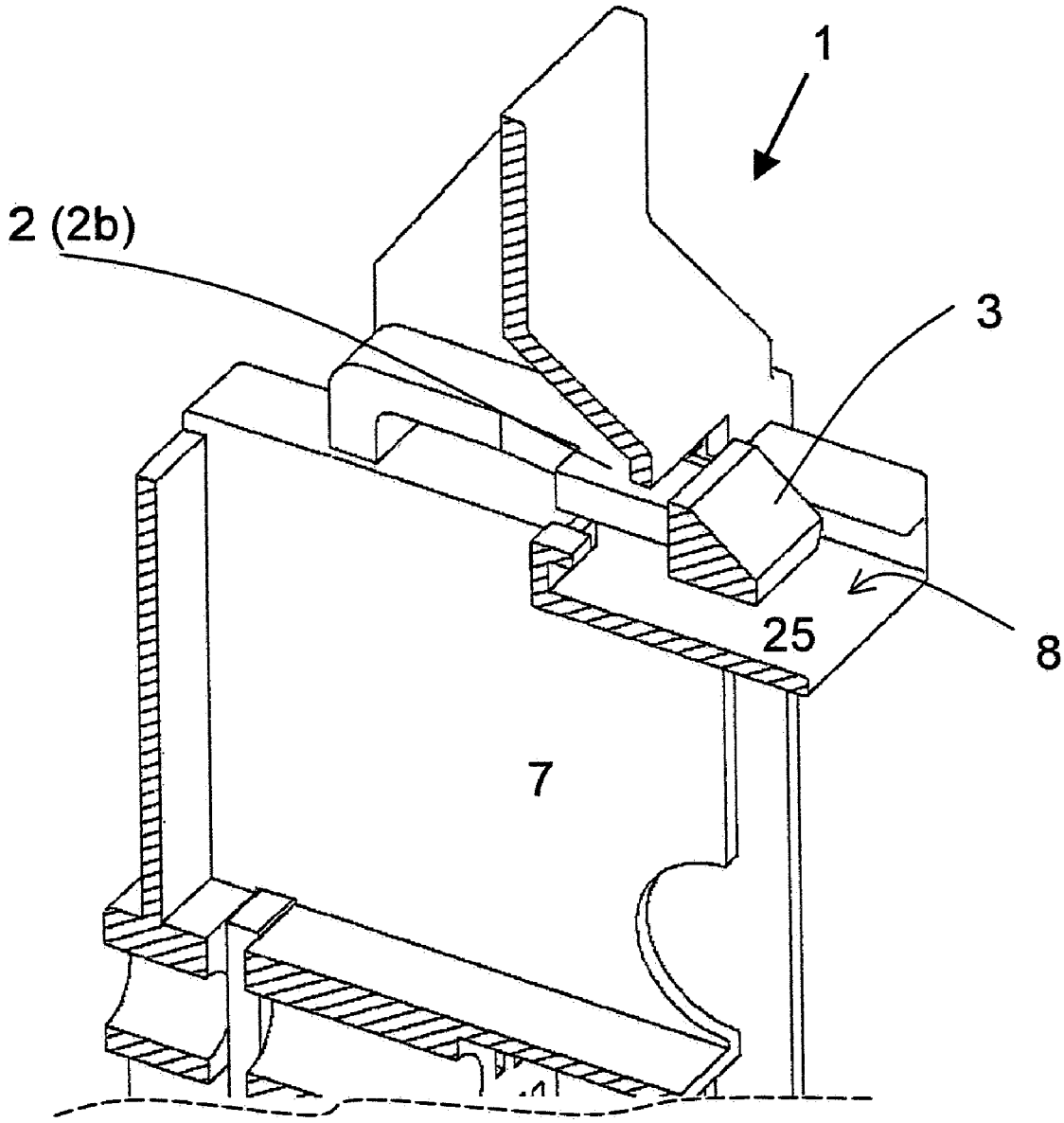
FIG. 3 shows a portion of FIG. 2 in an enlarged scale, with the slide not being illustrated.

As is particularly obvious from FIG. 2, the locking arm 2 is formed on to a side face, in this case to the upwardly facing surface of the housing 7 of the first element 1 in the connecting direction 4 so as to be positioned at the rear and extends at a distance from said surface and the housing 7 in the connecting direction 4. There are provided two separate locking arm portions 2*a*, 2*b* which, however, at their free ends, jointly carry the first locking portion 3 in the form of the projection. Between the two, there is formed a space 10. From the locked position as illustrated in FIG. 1, the locking arm 2 extends approximately parallel to the side edge and to the connecting direction 4 respectively in the untensioned condition or position of rest. Starting from said position, the locking arm 2, at its front end relative to the connecting direction 4, is provided with a first locking portion 3 in the form of the projection with an inclined face which, when the first element 1 is being connected to the second element 30, abuts the edge at the passage 31, which edge delimits the passage 31, so that there is applied a force to the locking arm 2 in the sense of the elastic deformation in the direction of the arrow 5 (deforming direction). Underneath the locking arm 2, in the region of the first locking portion 3 in the form of the projection at the housing 7, there is provided a guide 8 which comprises a guiding face 25.

In the guide 8, a securing slide 12 is adjustable in the setting direction 6 transversely to the connecting direction 4 and transversely to the deforming direction 5.

Figure 5:
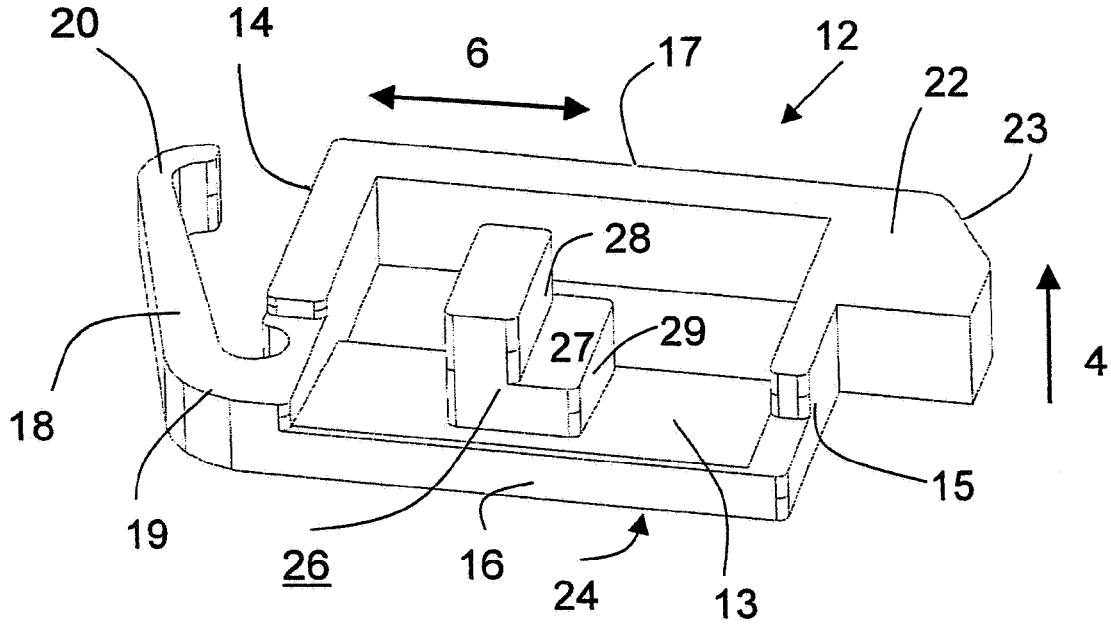
FIG. 5 is a perspective view of the securing slide used together with the plug element according to FIGS. 1 to 4.

So that further functions are understood more easily, there first follows a more de-tailed description of said securing slide 12 with reference to FIG. 5 in which it is shown in the form of a detail.

The securing slide 12 comprises a base portion 13, which is plate-shaped, and a first side 14, a second side 15 extending parallel thereto and a third side 16 and a fourth side 17 which extend at a right angle relative to sides 14 and 15 and parallel relative to one another. A spring element 18 in the form of an elastic spring arm is integrally formed on to the first side 14, starting from an end 19 formed on at the rear of the first side 14, and roughly indicated in the connecting direction 4, and extending to a free end 20 which distances itself from the first side 14 in the connecting direction 4 and which, towards its end, is bent towards the first side 14 and is supported on said end to avoid being excessively loaded during compression. From the side 15 which extends parallel to the first side 14, there extends a projection 22 which comprises an inclined control face 23 which, in the connecting direction 4, is positioned at the front of the projection 22 and which, while starting from the fourth side 17, extends against the connecting direction 4 and distances itself from the second side 15.

Figure 4:
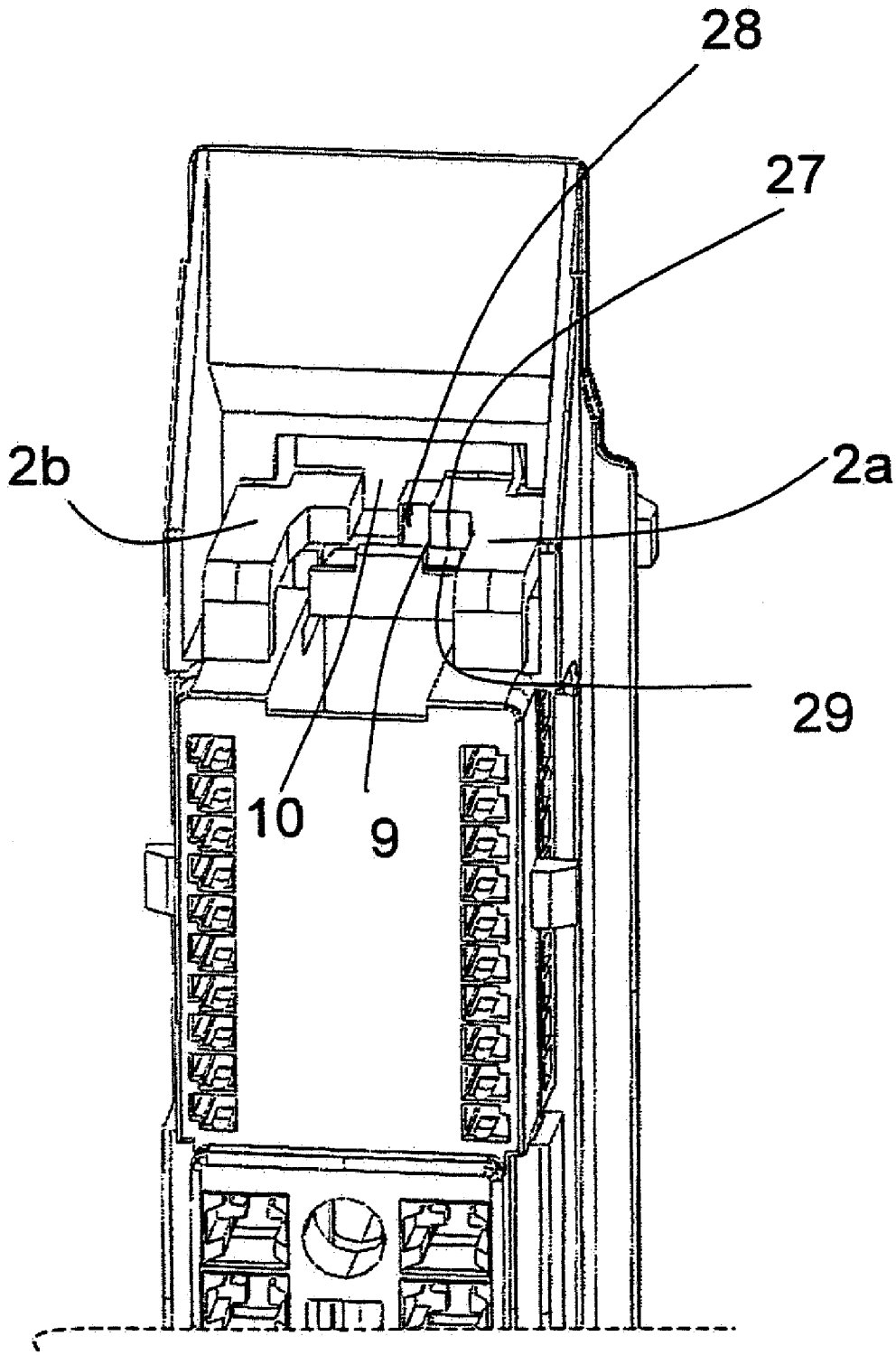
FIG. 4 is a perspective rear view of the first element in the form of a plug element of an electrical connection assembly.

A securing projection 26 is centrally formed on to the base portion 13 so as to project away from the contact face 24 by means of which the securing slide 12 rests on the guiding face 25 of the housing 7. The securing projection 26 comprises a first projection portion 28 which projects from a second projection portion 29 away from the con-tact face 24. The first projection portion 28 extends into the space 10 between the locking arm portions 2*a*, 2*b* and restricts the adjustment of the securing slide 12 in the setting direction 6. Furthermore, the securing projection 26, at its second projection portion 29, comprises a locking face 27 which points away from the contact face 24 and which cooperates with an associated abutment face 9 at the first locking arm portion 2*a* which is shown in greater detail in FIG. 4. Said abutment face 9 is arranged so as to point towards the guiding face 25.

The securing slide 12 is positioned in the space between the guiding face 25 of the guide 8 and the portion of the locking arm 2 which projects beyond same in the connecting direction 4, so that the base portion 13 of the securing slide 12, by means of the contact face 24, rests on the guiding face 25 of the housing 7 of the first element 1 in the form of the plug element. Its spring arm 18, by means of its free end 20, is supported on a lateral supporting base 21 of the housing 7 in the region of the guide 8, so that the securing slide 12, due to the spring force of the spring arm 18, is loaded in the setting direction 6 away from the supporting base 21 and thus transversely to the connecting direction 4 and transversely to the deforming direction 5 of the locking arm 2 towards its first position, with the locking face 27 being positioned underneath the abutment face 9 of the first locking arm portion 2*a* of the locking arm 2. As the second projection portion 29, in respect of height, has been dimensioned to be such that, in the untensioned condition of the locking arm 2, it is located directly underneath same, the locking arm 2 is prevented from being deformed in the deforming direction 5, i.e. towards the guiding face 25. In this condition, the projection 22 extends laterally beyond the housing 7 and, respectively, its portion entering the pas-sage 31, so that, when connecting the first element 1 in the form of the plug element to the second element 30 in the form of the plate-shaped receiving element, after the holding projection 11 was pivoted-in through the passage 31, it comes to rest against a side edge (stop 31) of the passage 31 which is positioned opposite its control face 23. This results in the securing slide 12 being set in the setting direction 6 against the force of the spring arm 18 in such a way that the first side 14 approaches the sup-porting base 21 and that the locking face 27 distances itself from the abutment face 9 at the locking arm 2, so that the securing projection 26, as a whole, i.e. also with the second projection portion 29, comes to rest in the space 10 between the two locking arm portions 2*a*, 2*b*. The locking arm 2 is thus allowed to be deformed towards the guiding face 25. In the connecting direction 4, the control face 23 is arranged in such a way that contact with the side edge (stop 33) delimiting the passage 31 already occurs before the locking arm 2, by means of its projection forming the first locking portion 3, also comes to rest against a side edge of the passage 31. The element 1 in the form of the first plug element can be moved into its final contact position relative to the second element 30 in the form of the plate-shaped receiving element. After the end position has been reached, the locking arm 2—as a result of the release of the first locking portion 3—can again assume its original untensioned starting position. After the locking arm 2 has assumed said position, the securing slide 12 returns from its second position in which it permits the locking arm 2 to be elastically deformed into its first position in which the locking face 27 provided at the securing projection 26 moves underneath the locking arm 2.

To release said additional locking mechanism, it is necessary to act manually or via a tool on the securing slide 12 to return same in the setting direction 6 into its second position, so that the locking arm 2 is released and can be transferred, either manually or by a tool or as a result of its design, into its position approaching the guiding face 25. The first element 1 in the form of the plug element, by means of the portion of the housing 7, which portion passes through the passage 31, can be released from the connection.

FIGS. 6 to 9 show the inventive locking mechanism being used in an electrical connection assembly with a first element 101 in the form of the plug element and a second element 130 in the form of an actuating lever associated with said first element 101. Said second element 130 in the form of an actuating lever is arranged at the housing 107 of the first element 101 so as to pivot around rotary journals 34 of which only one is visible. The side wall 36 of the second element 130 have each been provided with a respective bore and, via the latter, are positioned on the rotary journals 34. The two side walls 36 arranged parallel relative to one another are connected to one another by an actuating portion 37, so that they pivot together. Furthermore, the side walls 36 comprise engagement portions, for example in the form of slots which extend at variable distances from the rotary journals 34 and can be made to engage corresponding projections at a second plug connector connectable to the first element 101 in the form of a plug element in order to facilitate the connecting process especially in those cases where there is provided a plurality of contact elements, i.e. to reduce the connecting and releasing force.

For example, in order to ensure that, during transport when the first element 101 is located at a cable of a wire harness, the second element 130 in the form of the actuating lever does not catch other plug elements or similar components of the wire harness and in order to avoid an unintentional release of the connection between the first element 101 and the associated plug connector (not illustrated), there is provided a locking mechanism in accordance with the invention. It secures the second element 130 provided in the form of the actuating lever in a pivoted position relative to the housing 107 of the first element 101, with the secured position corresponding to the connected position between the first element 101 and the associated plug connector.

The housing 107 of the first element 101 is provided with a guide 108 at which a se-curing slide 112 is adjustable in the setting direction 106 between two positions. The first element 101 and, respectively, its associated housing 107 are associated with a locking arm 102 which projects towards the non-visible guiding face 125 of the guide 108 on which the securing slide 112 rests and is adjustably guided, so that the securing slide 112 is arranged between the locking arm 102 and the guiding face 125 of the guide 108, as explained in connection with the embodiment according to FIGS. 1 to 5.

The locking arm 102 differs from the embodiment according to FIGS. 1 to 5 in that it is produced in one piece. In the region of its first locking portion 103, the locking arm 102 comprises a contact face 109 which is provided in the form of a projection ex-tending towards the guiding face 125 of the guide 108 and underneath which the se-curing slide 112 positions itself in its first position relative to the locking face 127.

Figure 6:
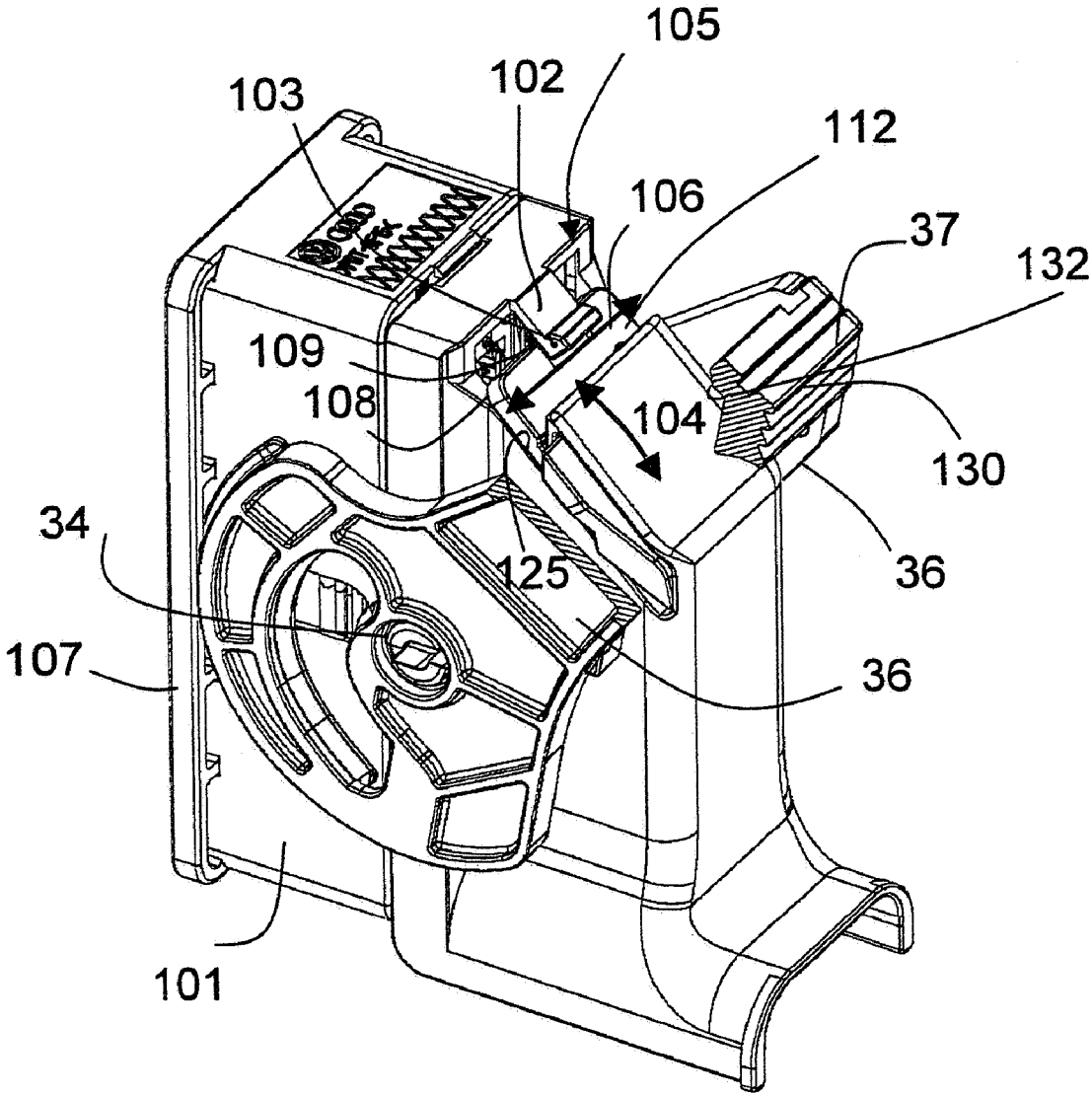
FIG. 6 is a perspective view, partially in section, of a second embodiment of the invention used when aiming at a locking effect between a first element in the form of a plug element of an electrical connection and an actuating lever pivotably articulated thereto as the second element of the inventive locking mechanism.
Figure 7:
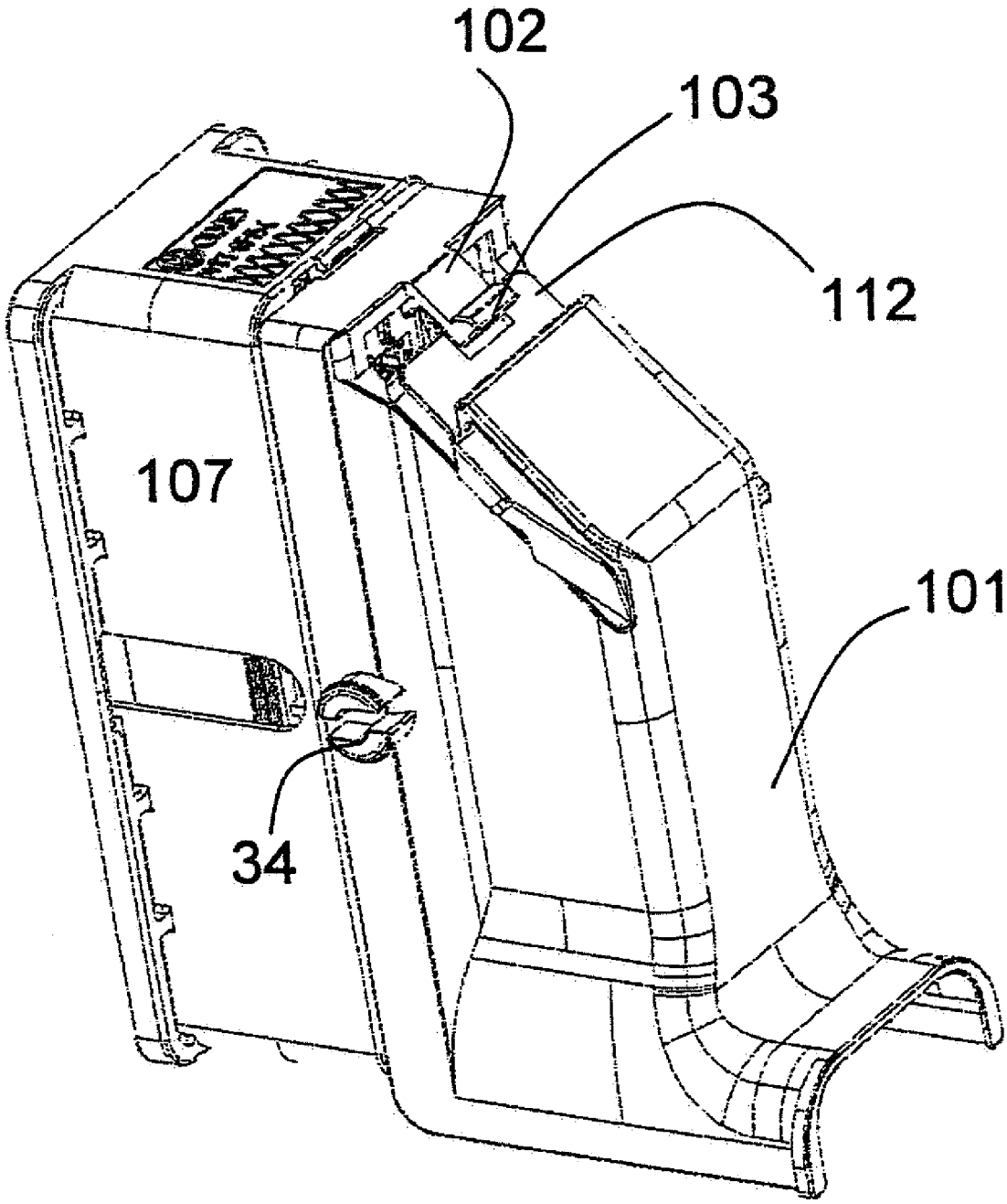
FIG. 7 shows the first element of FIG. 6 in the form of a plug element of an electrical connection wherein—for the purpose of describing the details more accurately—the second element in the form of the actuating lever is not shown.
Figure 8:
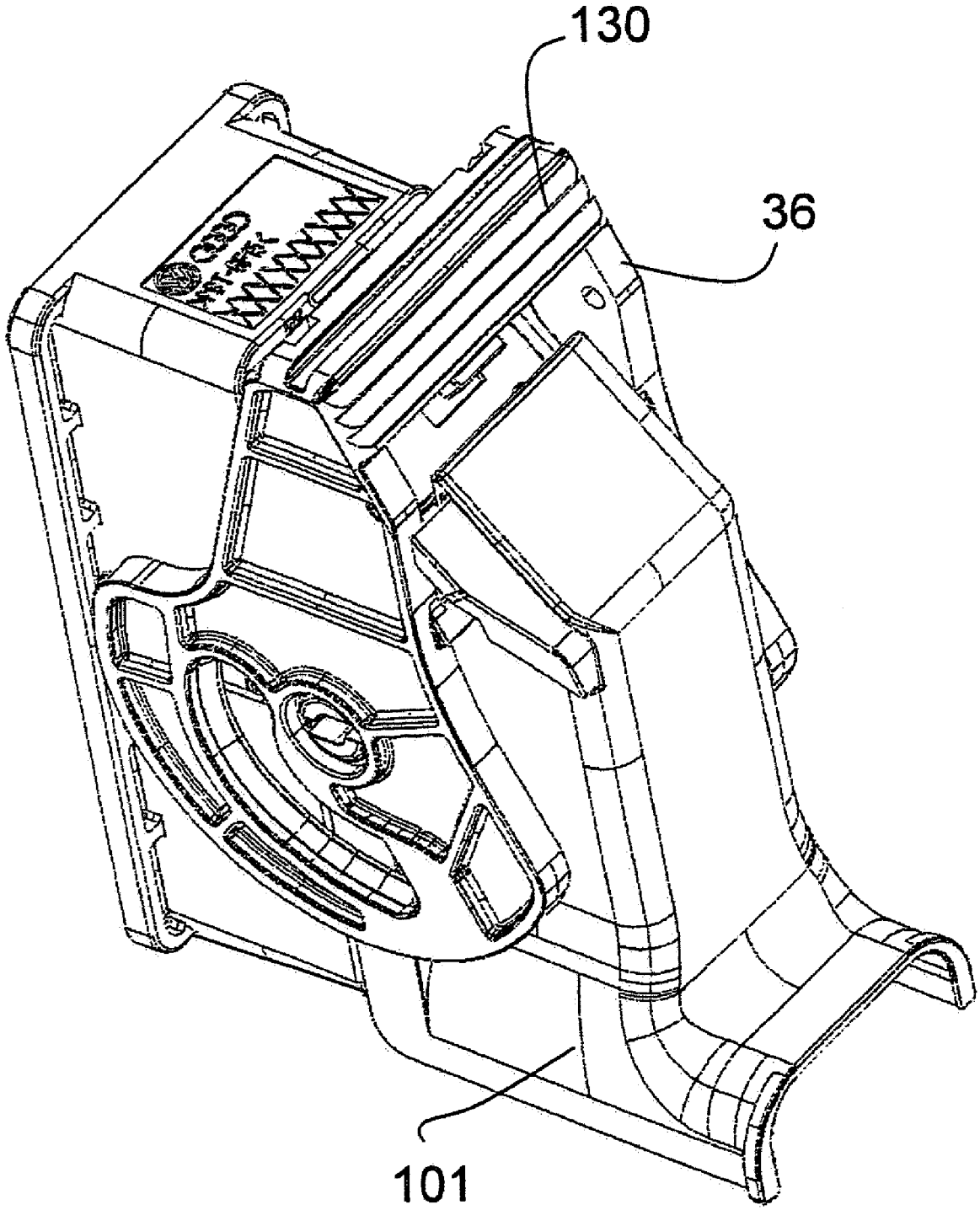
FIG. 8 is a perspective view of the plug element of FIG. 6, but with the actuating element being locked relative to the plug element.
Figure 9:
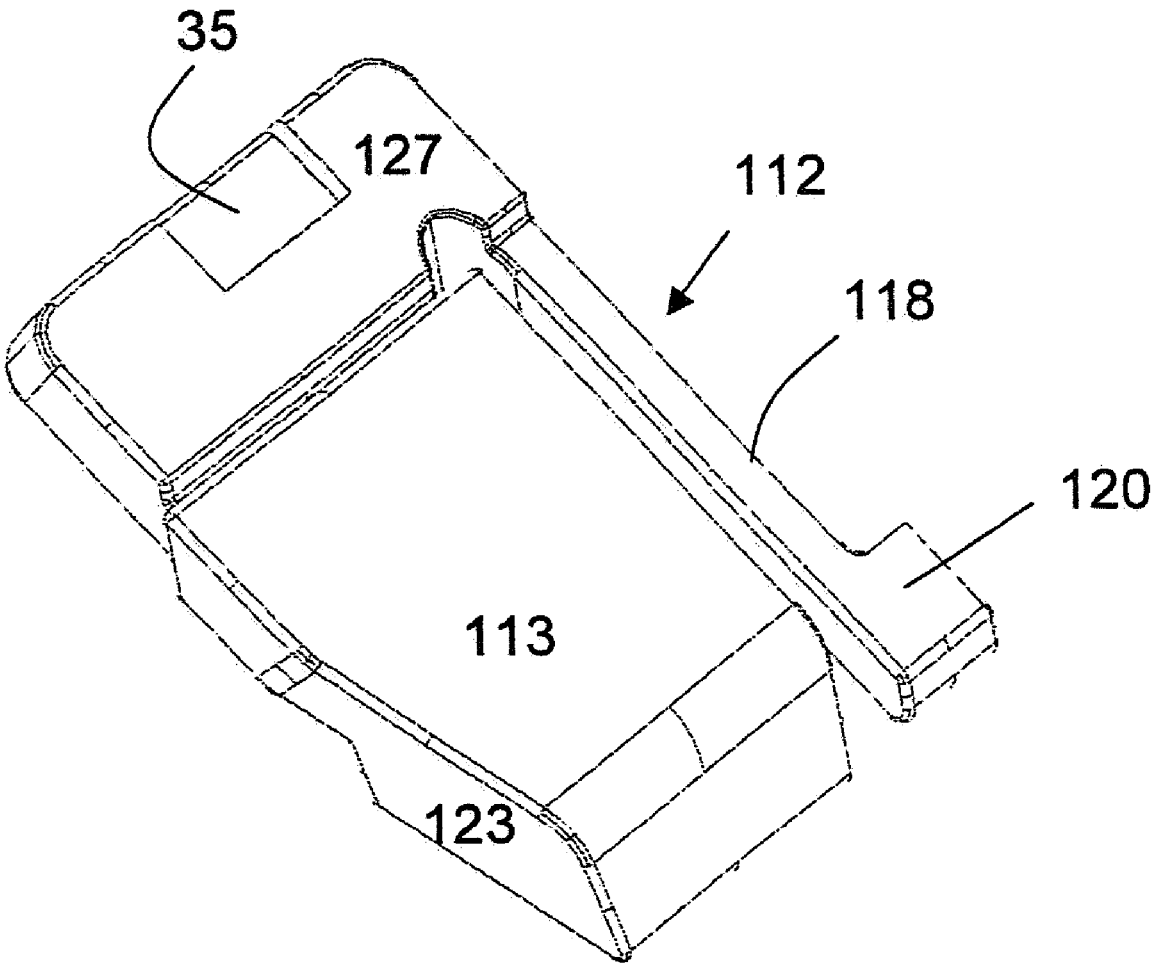
FIG. 9 is a perspective illustration, in the form of a detail, of the securing slide associated with the embodiment according to FIGS. 6 to 8.

The securing slide 112 is actuated by the second element 130 provided in the form of an actuating lever when, starting from the released position, it is transferred into a position which corresponds to the position according to FIG. 6. One of the two side walls 36 establishes contact with the control face 123 at the base portion 113 of the securing slide 112, which control face can be seen in FIG. 9, and adjusts the securing slide 112 against the force generated by the spring arm 118 by supporting its free end on a corresponding supporting base at the housing 107. As a result, the free end of the locking arm 102, i.e. the region which embraces the first locking portion 103 in the form of a hook-shaped projection, is able to enter a recess 35 in the securing slide 112. The locking arm 102 can be elastically adjusted from its untensioned position shown in FIG. 6 into a position approaching the guiding face 125. As soon as the second element 130, by means of its actuating portion 37 comprising the second locking portion 132, engages said first locking portion 103, the elastic spring force of the spring arm 118 becomes effective and returns the securing slide 112 into its first position, so that the locking face 127 is positioned underneath the abutment face 109 and prevents the locking arm 102 from being elastically deformed. After the securing slide 112 has again assumed its first position, it is possible to act on the securing slide 112 manually to return same in the setting direction 106 into its second position in order to release the locking arm 102. The first locking portion 103 of the locking arm 102 can be designed in such a way that when the actuating portion 37 of the second element 130 in the form of the actuating lever is subjected to a pulling effect in cooperation with the second locking portion 132 in the form of a locking face, it is possible to cause the locking arm 102 to swerve, i.e. to be adjusted towards the guiding face 125, with the second element 130 in the form of the actuating lever being released to allow further pivoting around the rotary journals 34.

What is claimed is:

1. A locking mechanism at an electrical connection assembly, comprising:

a first locking portion (3, 103) which is attached to an elastically deformable locking arm (2, 102) which forms part of a first element (1, 101) of the connection assembly;

a second locking portion (32, 132) which is connected to a second element (30, 130) of the connection assembly and which can be made to engage or to be disengaged from the first locking portion (3, 103);

a securing slide (12, 112) which is linearly adjustably guided in a guide (8, 108), which is urged by a spring element (18, 118) into a first position in which it prevents the locking arm (2, 102) from being elastically deformed and which comprises a control face (23, 123) which is loadable by the second element (30, 130) in such a way that the securing slide (12, 112) can be transferred into a second position in which it permits the locking arm (2, 120) to be elastically deformed, wherein the guide (8, 108) is associated with the first element (1, 101), wherein the locking arm (2, 102), in a deforming direction (5, 105), is elastically deformed towards the guide (8, 108) from an untensioned position and wherein the securing sleeve (12, 112) is adjustably guided in a setting direction (6, 106) between the locking arm (2, 102) and the guide (8, 108) transversely to the deforming direction (5, 105).

2. A locking mechanism according to claim 1, wherein the first element is a plug element (1) and the second element is a receiving element (30) to which the plug element (1) can be connected in a predetermined connecting direction;

the elastically deformable locking arm (2) is attached to the plug element (1) and is elastically deformable transversely to the connecting direction (4) in a deforming direction (5) and comprises a projection (3) in the form of a first locking portion projecting transversely to the connecting direction (4);

at the receiving element (30), there is formed a passage (31) which is entered by the locking arm (2) in the connecting direction (4) and which comprises a locking face (32) in the form of a second locking portion behind which the projection (3) is positioned in the connected condition of the plug element (1) and the receiving element (30) and that the receiving element (30) forms a stop (33) at the passage (31);

the securing slide (12) at the plug element (1) is arranged in a space between the guide (8) associated with the plug element (1) and the locking arm (2) so as to be adjustable transversely to the connecting direction (4) and transversely to the first deforming direction (5) of the locking arm (2); and during the process of the plug element (1) being connected to the receiving element (30), the control face (23) comes to rest against the stop (33) of the passage (31), so that the securing slide (12) is transferred against the force of the spring element (18) into the second position.

3. A locking mechanism according to claim 2, wherein the receiving element (30) is plate-shaped.

4. A locking mechanism according to claim 2, wherein the receiving element (30) is provided in the form of a portion of the body of a motor vehicle.

5. A locking element according to claim 2, wherein the plug element (1) comprises first contact elements and can be connected to a connector which comprises second electrical contact elements matching the first contact elements.

6. A locking mechanism according to claim 2, wherein the plug element comprises first electrical contact elements and the receiving element is provided in the form of the connector which can be connected directly to the plug element and which comprises second electrical contact elements which match the first electrical contact elements and, when being connected, come into contact with the first electrical contact elements.

7. A locking element according to claim 6, wherein the locking arm (2) serves to lock the plug element (1) with the connector.

8. A locking mechanism according to claim 1, wherein the first element is a plug element (101) which comprises first electrical contact elements and can be connected to a connector which comprises second contact element matching the first contact elements;

the securing sleeve (112) is attached to the plug element (101);

the second element is an actuating lever (130) which is pivotably connected to the plug element (101), which supports the process of connecting the plug element (101) to the connector and which comprises the second locking portion (132) which can be made to engage the first locking portion (103) by pivoting the actuating lever (130).

9. A locking mechanism according to claim 1, wherein the securing sleeve (12, 112) is plate-shaped and comprises a base portion (13, 113) which, on one side (14), comprises an integrally formed, elastically deformable spring arm in the form of a spring element (18, 118).

10. A locking mechanism according to claim 2, wherein at an abutment face (24) facing away from the guide (8, 108) of the plug element (1, 101), the securing slide (12, 112) comprises a securing projection (26) which, in the first position of the securing slide (12, 112), is positioned between the guide (8, 108) and an abutment face (9, 109) at the locking arm (2, 102) and blocks same to prevent same from being displaced and which, in the second position, is located outside the abutment face (9, 109) of the locking arm (2, 102).

11. A locking mechanism according to claim 10, wherein the locking arm (2) comprises two parallel and spaced locking arm portions (2*a*, 2*b*) and that the abutment face (9) is associated with one of the locking arm portions (2*a*, 2*b*); and the second position of the securing slide (12), the securing projection (26, 28) is arranged between the locking arm portions (2*a*, 2*b*).

12. A locking mechanism according to claim 9, wherein the control face (23, 123) is arranged on the side (15) of the base portion (13, 113) of the securing slide (12, 112), which side (15) faces away from the spring element (18, 118).

13. A locking mechanism according to claim 1, wherein the control face (23, 123) is arranged in the connecting direction (4, 104) in front of the first locking portion (3, 103) of the locking arm (2, 102).

* * * * *